United States Patent [19]

Foreman et al.

[11] 4,153,481

[45] May 8, 1979

[54] CYANIDE-FREE CARBURIZING PROCESS AND COMPOSITION

[75] Inventors: Robert W. Foreman, Bloomfield Hills; Gajen P. Dubal, Sterling Heights; Charles R. Fox, Livonia, all of Mich.

[73] Assignee: Park Chemical Company, Detroit, Mich.

[21] Appl. No.: 812,758

[22] Filed: Jul. 5, 1977

[51] Int. Cl.[2] ..... C21D 1/48

[52] U.S. Cl. ..... 148/15.5; 148/19; 148/20; 148/27; 148/29

[58] Field of Search ..... 148/15, 15.5, 19, 20, 148/27, 29

[56] References Cited

U.S. PATENT DOCUMENTS

| | | | |
|---|---|---|---|
| 1,796,248 | 3/1931 | Freudenberg | 148/15.5 |
| 2,568,860 | 9/1951 | Leininger et al. | 148/15.5 |

FOREIGN PATENT DOCUMENTS 944665 4/1974 Canada.

*Primary Examiner*—L. Dewayne Rutledge
*Assistant Examiner*—John P. Shechan
*Attorney, Agent, or Firm*—Krass & Young

[57] ABSTRACT

A cyanide-free molten salt carburizing process and composition comprising an alkali metal salt bath having a cover of finely divided graphite particles in a size range of about 100 mesh to about 300 mesh. The bath is operated in the temperature range of about 1550° F. to 1900° F. and is provided with mechanical agitation to produce entrainment of air through the surface cover and sufficient mobility of carbon monoxide coated graphite particles to produce carbon diffusion by contact into the surface of the parts immersed in the bath. Total graphite content is between about 1½% to about 7% of the active portion of the bath. The graphite is preferably of the synthetic type so as to produce an ash content below about 1%.

4 Claims, 1 Drawing Figure

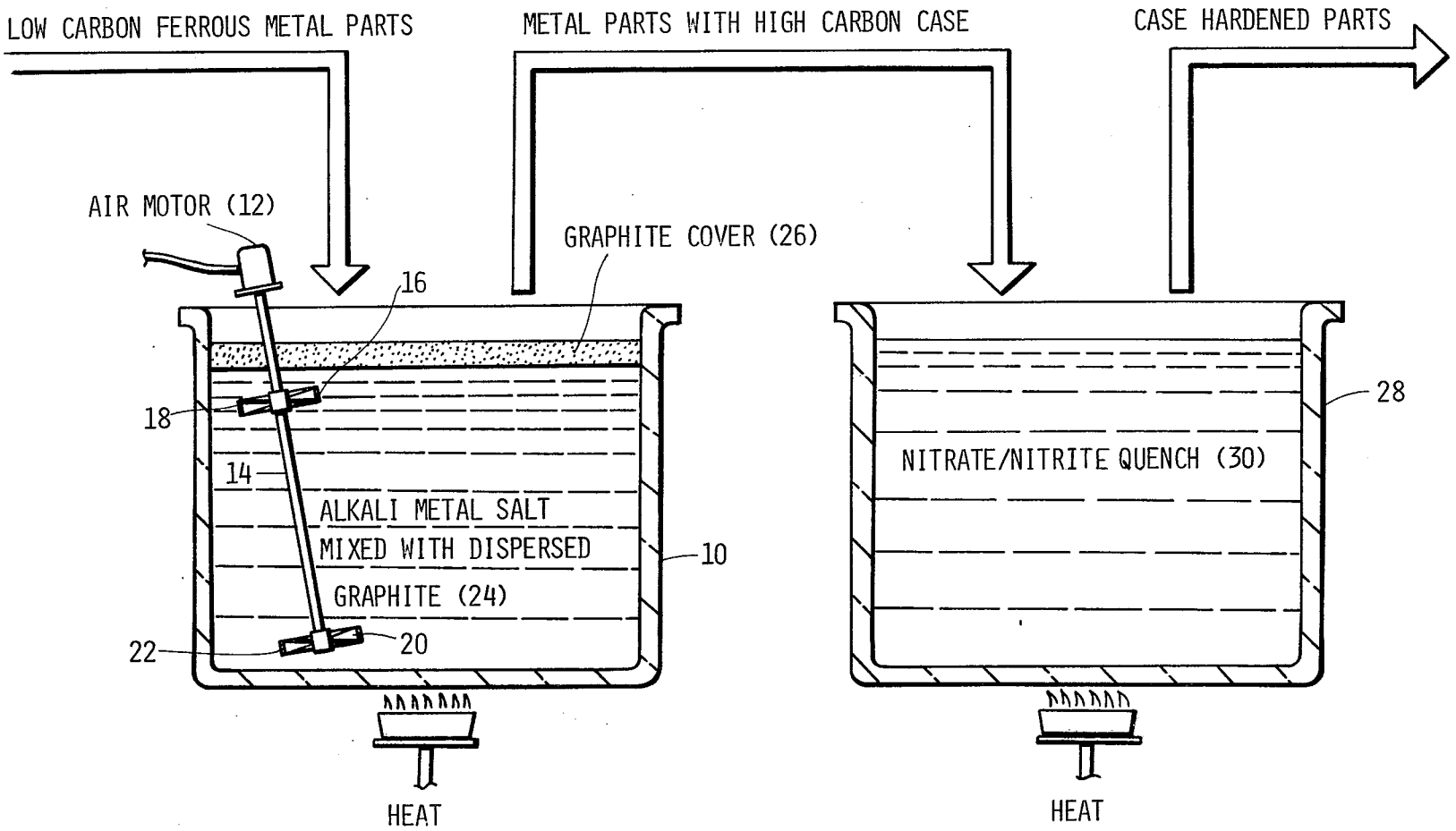
CASE HARDENED PARTS
METAL PARTS WITH HIGH CARBON CASE
LOW CARBON FERROUS METAL PARTS
28
NITRATE/NITRITE QUENCH (30)
HEAT
GRAPHITE COVER (26)
10
ALKALI METAL SALT
MIXED WITH DISPERSED
GRAPHITE (24)
16
20
14
18
22
AIR MOTOR (12)
HEAT

CYANIDE-FREE CARBURIZING PROCESS AND COMPOSITION

INTRODUCTION

This invention relates to improvements in carburizing processes of the type utilizing a cyanide-free molten salt bath into which ferrous metal parts are immersed for carbon diffusion purposes.

BACKGROUND OF THE INVENTION

Case hardening of ferrous metal parts has been accomplished for many years by way of carbon diffusion processes which utilize and/or produce highly toxic cyanide compounds. A cyanide process is disadvantageous for several reasons; for example, the cost of cyanide disposal treatment is very high due to the toxicity of the material; in addition, the cyanide bath is incompatible with commonly used low temperature quench salts of the nitrate/nitrite type.

Work has been done to provide a commercially acceptable salt bath carburizing process of the non-cyanide type thereby to reduce or eliminate the difficulties attending the use and handling of cyanide compounds; see, for example, Canadian Pat. No. 944,665 "Cyanide Free Carburizing Composition, Apparatus and Process" granted Apr. 2, 1974 to the Park Chemical Company, assignee of the present invention. The Canadian patent discloses a carburizing process in which carbon is diffused into ferrous metal parts by immersion in a bath consisting of a molten chloride/carbonate salt and having a cover of graphite particles.

While the cyanide-free carburizing process of the above-identified prior art was frequently capable of producing satisfactory results, we have determined that the actual carburizing mechanism was not phenomenologically understood. Hence, processes which appeared to be carried out in accordance with the prior art disclosures often produced unacceptable results, and the diagnosis of functional problems was difficult or impossible due to a lack of understanding of the basic process.

BRIEF SUMMARY OF THE INVENTION

We have discovered that the achievement of a stable cyanide-free molten salt carburizing bath which consistently produces commercially acceptable results lies in a critical balance of certain factors including: graphite character and composition in the active bath, the physical parameters of the cover, agitation and the resulting character and composition mobility of the graphite particles throughout the bath, and operating temperature. In the course of determining the criticality and effectiveness of this balance, we have discovered that the phenonenon which gives rise to carbon diffusion involves the spontaneous generation of nascent carbon monoxide as a gaseous coating around mobile graphite particles in the bath as a result of drawing air through the cover. Hence, the graphite particles serve not only as carbon sources but also as carriers of carbon monoxide to parts immersed in the bath.

Thus, our process, as more fully set forth hereinafter, involves steps which promote and enhance the graphite-carbon monoxide carrier system. In general, these steps include producing a molten alkali metal salt bath of a temperature in the range between about 1550° F. and 1900° F., providing a relatively thin cover on the bath of finely divided graphite particles having a very low ash content and particle sizes in the range of about 100 mesh to about 300 mesh, and mechanically agitating the bath to entrain air into the bath, to mobilize the graphite particles, and to establish a graphite population in the active part of the bath of about 1½% to about 7% by weight; this requires pulling the particles from the cover into the bath and entraining sufficient air through the surface of the bath to generate nascent carbon monoxide coatings around graphite particle carriers. By this mechanism, nascent carbon monoxide is brought into contact with the surface of low carbon ferrous metal parts to produce a quench hardenable Cementite case.

The quantity of graphite in the cover is preferably such as to produce, by suitable agitation, a bath comprising between about 1½% by weight and 7% by weight graphite evenly distributed and moving throughout the bath. This is accomplished by agitation using a propeller-type device which entrains air into the bath and gently but positively produces mobilization of the suspended particles.

In addition, the graphite is selected so as to exhibit an ash content of less than about 1%. This is best achieved by using synthetic rather than natural graphite. In addition, it is believed advantageous, although not essential, that the graphite particles be present in a mixture of particle sizes within the preferred range, the smaller graphite particle sizes contributing to the generation of carbon monoxide while the larger graphite particle sizes make up the necessary mechanical carriers. The concept of particle size mixture is not to be viewed as an essential component of the invention but rather as a theoretical adjunct to the basic phenomenological mechanism of cyanide-free carburizing set forth herein.

BRIEF DESCRIPTION OF THE DRAWING

The single FIGURE is a diagram of a hardening apparatus for low carbon ferrous metal parts, and representing the nature and composition of the molten salt bath which forms a principal part of the apparatus essential to said process.

DETAILED DESCRIPTION OF THE SPECIFIC EMBODIMENT

Referring to the drawing, the apparatus comprises an open container 10, preferably but not necessarily ceramic, of such size and shape as to provide a molten chloride/carbonate salt bath suitable for receiving commercial quantities of low carbon ferrous metal parts for the initial phase of a case-hardening process. Disposed over and adjacent the container 10 is an air motor 12 having an output shaft 14 which extends into the container and has connected thereto at spaced locations a set of three-blade propeller type impellers 16 and 20 disposed within cylindrical rings 18 and 22 respectively. Container 10 is substantially filled with a chloride/carbonate salt, the composition of which is more fully set forth hereinafter. In addition, a cover 26 of finely divided graphite particles is disposed on top of the salt mixture 24 in a fairly uniform fashion. The dimensions of the apparatus are such that the cover 26 lies five to eight inches above the impeller 16; impeller 20 is preferably spaced five to eight inches about the floor of the container 10.

Adjacent container 10 is a second container 28 containing a low temperature nitrate-nitrite quench bath 30. Both containers 10 and 28 include provisions for heating the contents thereof; for example, immersible electric heaters, exterior gas heaters, etc. In practice, the low carbon ferrous metal parts are immersed in the bath 24 of container 10 for a sufficient period of time to produce a carbon diffusion into the surface of the part or parts, after which the part of parts are removed from bath 24 and directly quenched in bath 30 to produce a hardened case. An intermediate quench may also be employed, depending upon the desired end result. Suitable quenchants include nitrate/nitrite salts, oil, and water.

In accordance with the invention, the alkali metal salt/carbonate mixture may comprise the combination of sodium or potassium chloride, present in sufficient quantity to make up between about 100% to 0% of the bath by weight, and sodium or potassium carbonate present in sufficient quantities to make up between about 0% and 100% of the bath by weight. Other alkali metal salts and other alkali metal carbonates may be employed; for example, barium and lithium.

Graphite cover 26 is preferably finely divided, high purity, synthetic graphite having an ash content of less than about 1%. The graphite cover comprises particles of a mesh size within the range of about 100 mesh to 300 mesh and preferably exhibiting a distribution of mesh sizes within the range. The cover should be reasonably uniform and maintained in a thickness of about ½" to 1", covering more than 90% of the salt bath surface and being easily broken by agitation provided by the impellers 16 and 20 so as to permit the entrainment of air through the cover 26 from the surface of the bath. When the impellers 16 and 20 are operating, the active portion of the bath 24 should be made up of about 1½% to about 7% graphite by weight, i.e., a sample taken below the cover would show such a percentage of suspended graphite particles. We have found that the lower limit of 1½% is that point at which carburizing activity appears to fall off rapidly, it being understood that some variation around this point should be expected. The high end of the range shows a less definite falling off of carburization and considerable latitude should be given here. The 7% figure has been found to represent that point at which the balance between good carburization activity and excessive cover begins to break down; i.e., greater percentages can be achieved only be creating more cover and inhibiting the air-entrainment function.

The operation and nature of the agitator means and its effect on the cover and mobilized graphite is extremely important to the proper and satisfactory attainment of carburizing in accordance with the invention. Agitation is considered proper when it can pull some of the graphite from the cover 26 into the bath and provide substantial mobility of the graphite particles, with the carbon monoxide coating thereon, uniformly throughout the bath. Agitation is excessive when a vortex is created. Over-agitation pulls too much air into the bath giving rise to an excess oxygen condition which produces carbon dioxide rather than carbon monoxide. In addition, it has been found that over-agitation tends to separate the carbon monoxide gas coatings from the graphite carriers, after which the carbon monoxide merely rises to the surface and burns off. Since the invention is dependent upon the mobility of carbon monoxide carrying graphite particles throughout the bath, over-agitation is to be avoided.

On the other hand, agitation is insufficient when it fails to pull graphite from the cover and entrain sufficient air for the generation of carbon monoxide around the graphite particles in the bath. The following table is illustrative of the proper agitation combinations for various bath configurations and sizes. Three-bladed propellers with peripheral rings around the blades have been found satisfactory. It is to be understood, however, that other agitation means may be used in accordance with the principles of the present invention.

TABLE I

| SALT BATH DATA | | | AGITATOR DATA | | | | |
|---|---|---|---|---|---|---|---|
| Area having cover, $ft^2$ | Length to Width Ratio | Molten Salt Depth ft. | Diameter of 3 bladed propeller inches | No. of Propellers on Each Shaft | No. of Agitators | Position of Propeller (Relative to salt level | Speed, r.p.m |
| Up to 5 | 1 to 2.5 | <1.5 | 3 | 1 | 1 | 4" from top | 600 800 |
| Up to 5 | > 2.5 | " | " | 1 | 2 | " | " |
| 6-11 | 1 to 2.5 | " | 4 | 1 | 1 | " | " |
| " | " | 1.5-3 | 4 | 2 | 1 | 4" from top and bottom | 800 - 1000 |
| " | > 2.5 | <1.5 | 4 | 1 | 2 | 4" from top | 600 - 800 |
| " | " | 1.5-3 | 4 | 2 | 2 | 4" from top and bottom | 800-1000 |
| 12-25 | 1 to 3 | <1.5 | 4 | 1 | 2 | 4" from top | 600-800 |
| " | " | >1.5 | 4 | 2 | 2 | 4" from top and bottom | 800 - 1000 |

An air motor is preferred to an electric motor in view of the intense heat which is present near the surface of the bath. The motor should be situated at least one foot or more away from the top of the salt bath and a heat deflecting circular shield near the upper end of the shaft 14 may be advisable.

EXAMPLE I

The bath 24 is started with a base salt consisting of 60% sodium chloride and 40% sodium carbonate, no graphite cover being present initially. After melting, the temperature of the bath is raised to 1500° F. and air motor 12 is actuated to begin agitation. Finely divided synthetic graphite particles having a mesh size according to the following distribution are slowly added to sparsely cover the bath, agitation continuing during the application of the cover:

| | |
|---|---|
| 24% | +200 mesh |
| 34% | 200–325 mesh |
| 42% | −325 mesh |

All graphite has an ash content of about ½%. The graphite cover is maintained in a thickness of about ½" to 1", should be easily broken by agitation and cover about 90% of the bath surface. Graphite is stirred into the bath by agitation; a sample shows graphite content about 4% of the active bath by weight.

The bath is further heated to a normal operating temperature of 1700° F. Approximately five hours are then permitted to lapse before low carbon parts are added for carburizing. This break-in period is necessary only on the initial start-up. When the bath is fully active the cover continuously emits small pops of flame.

When carburizing small parts, nesting or stacking should be avoided because of the necessity for a surface contact of the carbon monoxide carrying graphite particles with the low carbon metal parts. If flat surfaces are in close contact, the carburizing media may not be able to penetrate thoroughly thus producing an uneven case. Parts and baskets should be packed randomly and repositioned occasionally by brief shaking.

Parts immersed in the above bath for 1.5 hours at 1700° F. exhibited a total case depth of 0.030" and surface hardness after brine quench of 62 Rc.

EXAMPLE II

Basic operating conditions the same as Example I except the bath is 10% potassium chloride and 90% sodium carbonate. The bath is operated at a carburizing temperature of 1900° F. with graphite particles of about 200 mesh present in quantity so as to make up 3.16% of the bath by weight. Low carbon ferrous metal parts are carburized for two hours producing a total case depth of 0.066" and surface hardness, after brine quench, of 63 Rc.

EXAMPLE III

Basic operating conditions the same as Example I except the bath is stabilized at approximately 1600° F. Low carbon ferrous parts are immersed for one hour and produce an effective case of 0.008", 62 Rc (equivalent).

EXAMPLE IV

Basic operating conditions the same as Example I except mobilized graphite content in the active bath is about 1½% by weight. Surface hardness resulting: about 61 Rc. Below 1½%, surface hardness falls off; example, 0.85% graphite produces surface hardness of only about 58.2 Rc.

It is to be understood that the foregoing examples are illustrative in nature and are not to be construed in a limiting sense.

The embodiments of the invention in which an exclusive property or privilege is claimed are defined as follows:

1. A non-cyanide carbon diffusion process for case-hardening ferrous metal parts comprising the steps of:

producing a molten bath consisting essentially of an alkali metal chloride and an alkali metal carbonate in the temperature range between about 1550° F. and 1900° F.;

producing a cover on the bath consisting essentially of uniformly distributed graphite particles of low ash content and having particle sizes in the range of about 100 mesh to about 300 mesh; and mechanically agitating the bath sufficiently to produce a substantially continuous flow of graphite particles from the cover into and throughout the bath to produce a graphite content in the active portion of the bath of between about 1½% by weight and about 7% by weight; and to produce the entrainment of air through the cover, to produce carbon diffusion into the surface of low carbon ferrous metal parts immersed in the bath.

2. The process as defined in claim 1 wherein the ash content of the graphite is less than about 1%.

3. The process as defined in claim 1 wherein the agitation is provided by immersed impeller means.

4. A molten salt composition for use in a non-cyanide carbon diffusion process for case-hardening ferrous metal parts consisting of:

from about 0.001% to about 99.99% of a molten alkali metal chloride and from about 0.001% to about 99.99% of a molten alkali metal carbonate in the temperature range between about 1550° F. and 1900° F.; and graphite particles having a mesh size in the range of about 100 mesh to about 300 mesh forming a cover on the bath and being uniformly dispersed throughout the bath and present in the amount of about 1½% by weight to about 7% by weight of the bath and having an ash content of less than about 1%.

* * * * *